United States Patent [19]

Wojciechowski

[11] Patent Number: 4,494,892

[45] Date of Patent: Jan. 22, 1985

[54] TRAFFIC BARRIER, BARRIER ELEMENT AND METHOD OF CONSTRUCTION

[75] Inventor: Longine J. Wojciechowski, Potomac, Md.

[73] Assignee: Henri Vidal, France

[21] Appl. No.: 454,412

[22] Filed: Dec. 29, 1982

[51] Int. Cl.[3] ..... E01F 15/00

[52] U.S. Cl. ..... 404/6; 404/9; 404/72; 405/286; 52/102; 52/251

[58] Field of Search ..... 404/6, 7, 8, 9, 72, 404/73; 264/35; 405/286, 284, 287; 52/169.7, 250, 251, 102, 166, 174

[56] References Cited

U.S. PATENT DOCUMENTS

| | | | |
|---|---|---|---|
| 2,954,645 | 10/1960 | Bennett, Jr. | 52/169.7 |
| 3,225,548 | 12/1965 | Hayden | 405/286 |
| 3,678,815 | 7/1972 | Younker | 404/6 X |
| 4,059,362 | 11/1977 | Smith | 404/6 |
| 4,067,166 | 1/1978 | Sheahan | 405/284 X |
| 4,126,001 | 11/1978 | Shimada et al. | 405/287 |
| 4,260,296 | 4/1981 | Hilfiker | 405/284 |

FOREIGN PATENT DOCUMENTS

| | | | |
|---|---|---|---|
| 453468 | 5/1975 | U.S.S.R. | 404/6 |

*Primary Examiner*—Stephen J. Novosad
*Assistant Examiner*—Beverly E. Hjorth
*Attorney, Agent, or Firm*—Burns, Doane, Swecker & Mathis

[57] ABSTRACT

The invention relates to a precast concrete traffic barrier element and a method of construction for a traffic barrier using the element on a vertical face of a retaining wall. The barrier element is a profiled block of precast concrete having a bottom surface with a longitudinally extending channel therein. The traffic barrier element is supported on the retaining wall with a top surface of the vertical face being received within the channel. Anchoring bars projecting from an interior portion of the traffic barrier element are embedded in a cast in situ counterweight positioned adjacent to the barrier. In a preferred embodiment, a plurality of traffic barrier elements are anchored in a single counterweight.

14 Claims, 4 Drawing Figures

Fig. 1
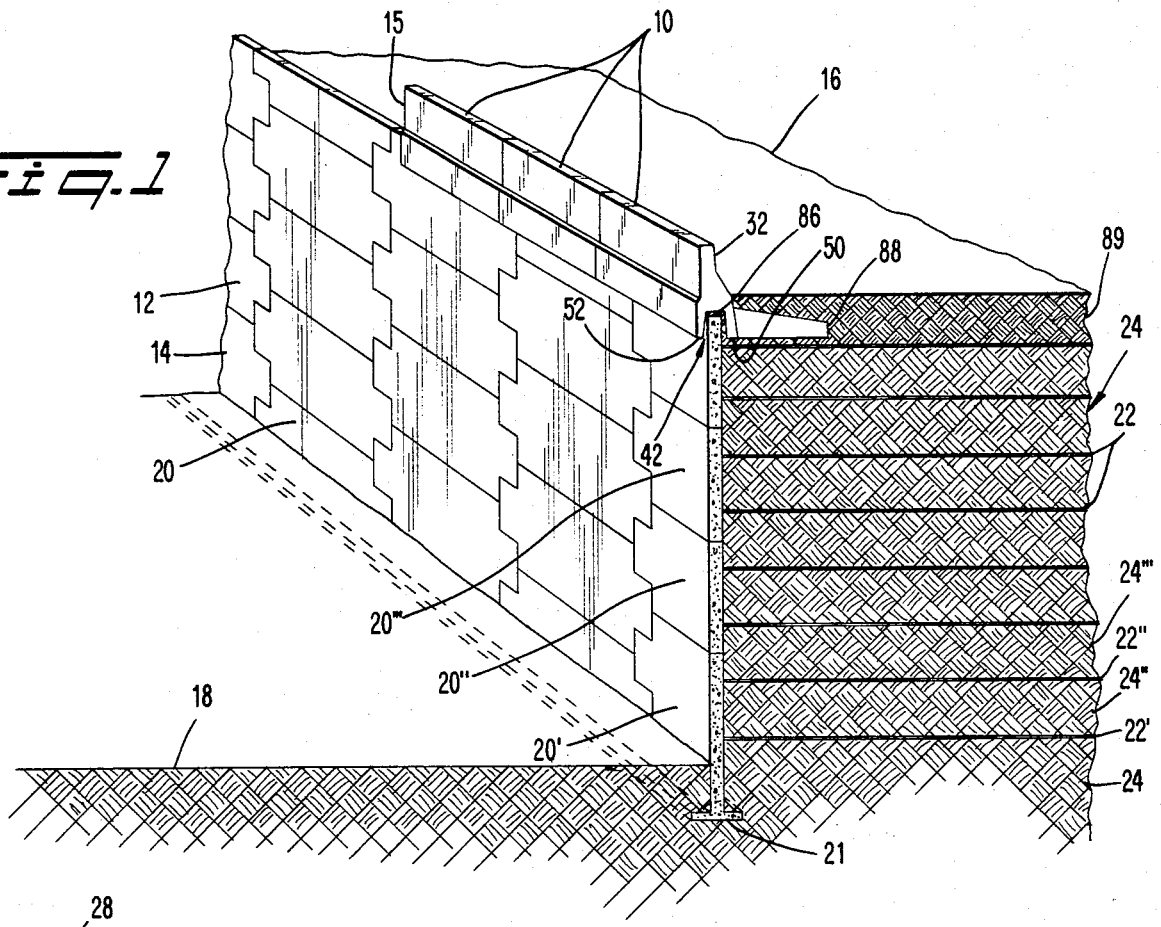
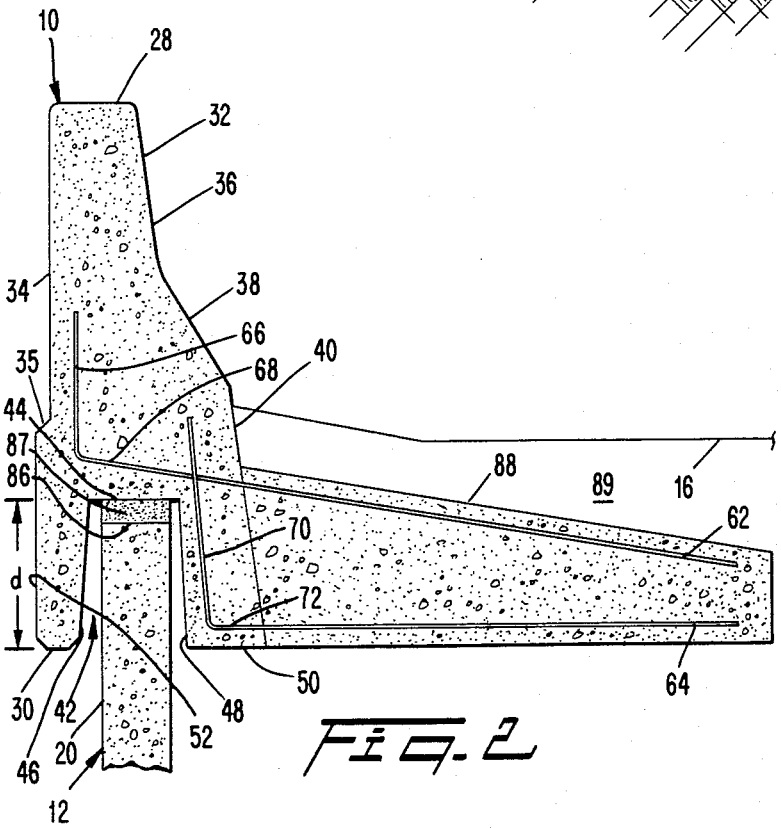
Fig. 2
Fig. 3
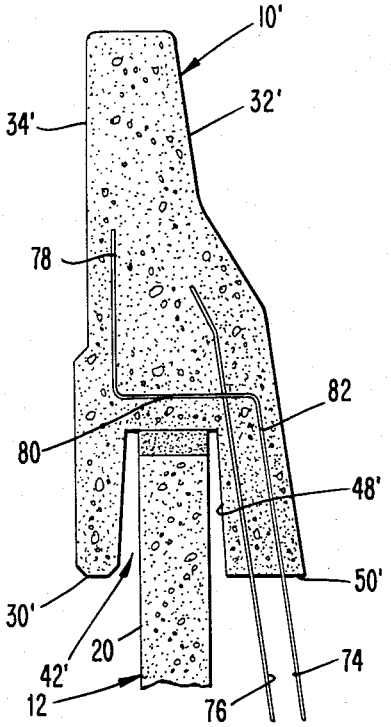

TRAFFIC BARRIER, BARRIER ELEMENT AND METHOD OF CONSTRUCTION

BACKGROUND AND SUMMARY OF THE PRESENT INVENTION

The present invention is directed to a precast concrete traffic barrier. More specifically, the present invention relates to a precast concrete traffic barrier element and a method of constructing a traffic barrier on a face of a structure such as a retaining wall.

Traffic barriers are used on roads to restrain a moving vehicle from crossing into an oncoming lane of traffic or from driving off a traffic surface. The traffic barrier is usually anchored in the traffic surface to absorb an impact from the moving vehicle and to resist overturning of the barrier due to the impact. Many times, an impact receiving side of the traffic barrier is profiled (e.g., a concrete traffic barrier having a New Jersey profile) for deflecting or redirecting the moving vehicle back onto the road.

Traffic barriers are especially useful on elevated structures, such as bridge and highway ramps, in order to restrain an incident vehicle from crashing through the barrier and falling from a precipitous edge of the elevated road. Elevated roads are often constructed by piling earth or soil onto metal reinforcements to form a frictionally stabilized composite earth structure for supporting and elevating the road (e.g., see U.S. Pat. No. 3,686,873). The composite earth structure may include a wall face of interfitted panels for covering the sides of the composite earth structure. Often times, an edge of the traffic surface is required to be close to the wall face and in such cases, there is a need for a traffic barrier positioned adjacent to the wall face. If there exists a sufficient space between the face and the edge of the traffic surface, then the traffic barrier may be positioned and adequately anchored without interfering with the wall face. However, a problem exists in constructing and anchoring the traffic barrier when the traffic barrier is supported on or closely adjacent to the face of a retaining wall, such as the composite earth structure.

In an effort to construct and adequately anchor a traffic barrier supporrted on a wall face of a stabilized earth structure, a concrete traffic barrier has been cast-in-place on a top edge of the face so as to be integral with the wall face. During construction, scaffolding is erected adjacent to the face and workmen on the scaffolding construct forms for the traffic barrier on the top edge of the face. Reinforcing bars may be placed in the forms to strengthen the device. Concrete is then poured into the forms and allowed to set. The forms are then removed and a subterranean counterweight slab is cast-in-place to anchor the barrier.

Alternatively, a post and rail traffic barrier has been embedded in a precast concrete wall cap. The present cap is supported on an upper surface of the soil inside of the wall face. A lip extending from the cap overhangs the vertical face and a gap exists between the lip and a top edge of the face. An in situ subterranean extension of the cap is then cast-in-place to anchor the cap with the post and rail traffic barrier situated thereon.

While the above-described cast-in-place traffic barrier is adequately anchored, such a barrier requires the construction of forms in which the concrete is poured and allowed to set. The use of forms, however, is costly and time consuming since numerous workmen are required to build the forms, place the steel, and pour the concrete. Further, scaffolding must be erected adjacent to the face in order to support the workmen building and removing the forms. As a result, the construction of the cast-in-place traffic barrier is a slow and labor-intensive operation.

The construction of the above-described precast wall cap involves less form-work than the cast-in-place traffic barrier, but it still requires forms for constructing the in situ extension of the wall cap. Further, the wall cap does not rest on the top edge of the face, but is supported on the soil inside of the face. As a result, the soil inside of the face and underneath the cap must be graded in order to properly position the cap. The precast wall cap also employs a post and rail traffic barrier which is designed to absorb impact from an incident vehicle, rather than redirect the vehicle.

The present invention relates to a traffic barrier for use as a safety device to resist accidental passage of an incident vehicle over a precipitous edge. The traffic barrier includes a wall structure defining a top edge having both a wall face fashioned from interfitted facing elements and a traffic surface. A plurality of precast concrete traffic barrier elements are positioned in an end-to-end relationship along the top edge. In this manner, the need for on-site forms is eliminated since the element is precast. Scaffolding is also eliminated since the precast element can be lifted into position by a crane situated on the traffic surface. In addition, the precast barrier element, unlike the present wall cap, rests on the top edge of the wall face so that the element is properly positioned without grading. As a result, the precast traffic barrier of the present invention requires less labor and time to construct than both of the above-described traffic barriers.

Each barrier element has a side facing the traffic surface with a cross-sectional profile for redirecting an incident vehicle toward the traffic surface. A bottom surface of each barrier element has a longitudinally extending channel therein which is sized to receive the top edge of the wall structure for partially supporting the barrier element. The barrier element has a length sufficient to cover at least one vertical joint between interfitted facing elements in order to laterally stiffen the wall face. An attachment mechanism toward the traffic surface side of the wall structure connects the barrier element with a cast in situ counterweight which engages the attachment mechanism of at least two barrier elements to stiffen the barrier while counterbalancing vehicle impact forces. As a result, the precast concrete traffic barrier according to the present invention has a greater impact resistance than post and rail traffic barriers.

The method of constructing a traffic barrier on a top edge of a wall face of an earth structure having a traffic surface thereon includes the step of positioning a precast concrete traffic barrier element on the wall face with the top edge of the wall being received within a longitudinally extending channel in a bottom surface of the barrier element. In positioning the barrier element, the barrier element is partially supported on the top edge of the wall face with anchoring bars projecting from the barrier element toward the traffic surface. The anchoring bars are then anchored in a cast in situ counterweight positioned adjacent to the traffic surface.

Many objects and advantages derived from the present invention will become apparent to those skilled in the art from this specification.

BRIEF DESCRIPTION OF THE DRAWINGS

FIG. 1 is a perspective view of a wall face of a structure such as a retaining wall having a precast concrete traffic barrier according to the present invention situated thereon;

FIG. 2 is a cross-sectional view of one embodiment of a precast concrete traffic barrier element illustrated in FIG. 1;

FIG. 3 is a cross-sectional view of a further embodiment of a precast concrete traffic barrier element according to the present invention.

DETAILED DESCRIPTION OF THE PREFERRED EMBODIMENT

Figure 4:
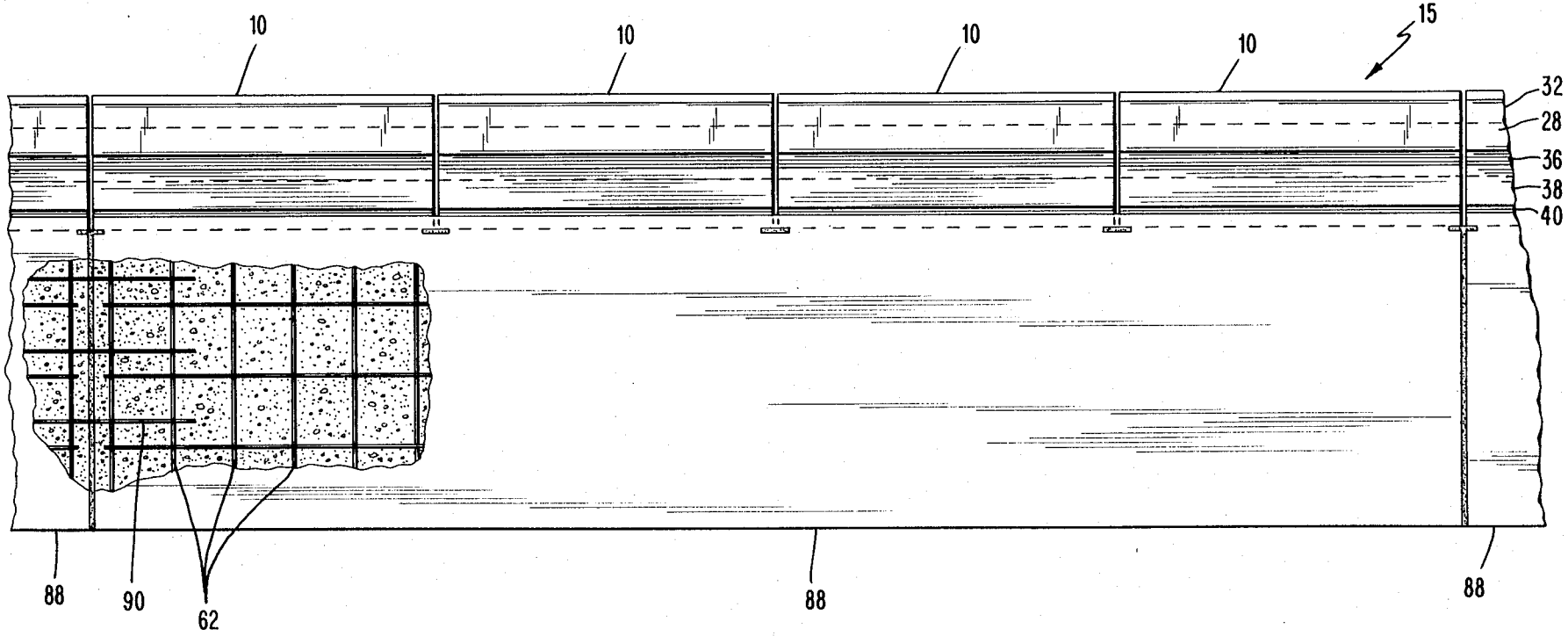
FIG. 4 is a plan view of a plurality of precast concrete traffic barriers anchored in a cast-in-place counterweight having a section broken away.

With reference to FIG. 1, a plurality of precast concrete traffic barrier elements 10 are supported on a wall face 12 of a structure 14 such as a retaining wall to form a traffic barrier 15. The precast concrete traffic barrier elements 10 restrain a moving vehicle on an elevated traffic surface 16 from travelling over a precipitous edge of the wall face 12 and from falling to a lower level 18.

The precast concrete traffic barrier according to the present invention may be used in connection with various retaining wall structures, but it is especially useful in connection with a type of frictionally stabilized composite earth structure disclosed in U.S. Pat. No. 3,686,873 issued to Vidal and incorporated herein by reference. Briefly, such a structure includes a plurality of mosaically interfitted facing elements or panels 20 which form the wall face 12. Each panel 20 is connected to a plurality of reinforcements 22 extending into soil inside of the composite earth structure 14.

The composite earth structure is constructed by first forming a footer 21 along the length of the structure 14. A first row of panels 20' is positioned on the footer 21 and then a first layer of soil 24' is backfilled and compacted behind a portion of the panel 20'. A first planer array of reinforcements 22' is positioned over the first layer of soil and then attached to the panels 20'. Successive rows of panels, such as 20''' and 20''' are then positioned over previous rows of panels with successive layers of soil, such as 24'' and 24''' being backfilled and compressed over successive planner arrays of reinforcements, such as 22' and 22''. It is noted that in constructing the structure 14, a crane for lifting the panels 20 into position may be situated behind the wall face 15, rather than in front of the wall face 15 on the lower level 18.

In operation of the composite earth structure 14, the layers of soil frictionally engage the reinforcements 22 to form a composite mass 24 of earth and reinforcements that acts as a wall to stabilize unreinforced soil adjacent to the mass 24. With this construction, the panel 20 forming the wall face 12 do not support a significant amount of soil pressure. Each panel only supports its own weight plus the weight of any panels and traffic barriers supported above it. The panels 20, however, do provide a cosmetic cover for the composite earth structure 14.

With reference to FIG. 2, one embodiment of the precast concrete traffic barrier element 10 according to the present invention includes an elongated block of precast concrete having a top surface 28, a bottom surface 30 and two sides 32, 34. One side 32 preferably has a cross-sectional New Jersey profile for deflecting or redirecting a moving vehicle back towards the traffic surface 16. The New Jersey profile includes an upper inclined surface 36 extending from the top surface 28 and sloping downwardly at a first acute angle with respect to a vertical plane. An intermediate inclined surface 38 extends from the upper inclined surface 36 and slopes downwardly at a second acute angle which is greater than the first angle. A lower inclined surface 40 extends between the intermediate inclined surface 38 and the bottom surface 30. The lower inclined surface 40 slopes downwardly at a third acute angle which is less than the second angle.

A relatively unprofiled side 34 is opposite from the profiled side 32. As illustrated in FIG. 2, the unprofiled side 34 may have an inclined portion 35.

The bottom surface 30 of the precast traffic barrier element has a longitudinally extending channel 42 therein. Preferably, the channel 42 has a trapezoidal configuration with an internal face 44 which is parallel to the bottom surface 30. Two sidewalls 46, 48 of the channel 42 extend from the internal face 44 to the bottom surface 30. Preferably, an outer sidewall 46 diverges downwardly in a direction away from the profiled side 32 and an inner sidewall 48 diverges downwardly in an opposite direction away from the unprofiled side 34. The channel 42 divides a lower section of the precast concrete traffic barrier element 10 into two lips 50, 52. An inner lip 50 is defined by the concrete between the lower inclined surface 40 of the profiled side 32 and the inner sidewall 48 of the channel 42. An outer lip 52 is defined by the concrete between the unprofiled side 34 and the outer sidewall 46 of the channel 42.

The channel 42 has a significant depth d and length. For example, the depth d may be approximately fifteen (15) inches or twenty-five percent (25%) of the entire height of the barrier element 10. Additionally, the depth of the channel exceeds the width of the channel, e.g., as shown in FIG. 2. The channel 42 is sized to receive a top edge 86 of the panels 20 which form the wall face 12. When an element 10 is positioned on the structure 14, the outer and inner lips 50, 52 straddle the wall face 12 with the internal face 44 of the channel 42 supporting the element 10 on the top edge 86. Since curved structures are typically built with chordal segments (panels here), the channel 42 is also sized so that for a given length its width will accommodate a predetermined curvature of the supporting structure and will accommodate construction tolerances. The channel 42 also extends for the length of the barrier element 10. Preferably, the barrier 10 has a length sufficient to cover at least one vertical joint between the interfitted panels 20 (FIG. 1).

With reference to FIG. 2, transversely extending first sets of anchoring bars 62, 64 are partially embedded within the barrier element and partially projecting outwardly from the inner lip 50 of the precast concrete traffic barrier element 10 at spaced intervals. Preferably, six first sets of achoring bars 62, 64 are equally spaced along the length of the element 10. Each first set includes an upper anchoring bar 62 and a lower anchoring bar 64. Preferably, the upper anchoring bar 62 has a vertical section 66 embedded within the concrete adjacent to the unprofiled side 34 and an inclined section 68 embedded above the channel 42. The lower anchoring bar 64 has a vertical section 70 embedded adjacent to the inner sidewall 48 of the channel 42 and a horizontal section 72 embedded above the bottom surface 30. Both the upper and lower anchoring bars 62, 64 extend through the inner lip 50 and project through the lower inclined surface 40 of the profiled side 32.

A further embodiment of the precast concrete traffic barrier element is illustrated in FIG. 3 and is similar to that described with reference to FIG. 2, except with respect to the anchoring bars. Second sets of anchoring bars 74, 76 extend outwardly and downwardly from the barrier element 10'. Each second set includes an outer anchoring bar 74 and an inner anchoring bar 76. The outer anchoring bar 74 has a vertical section 78 embedded within the concrete adjacent to the unprofiled side 34' and a horizontal section 80 embedded above the channel 42'. An inclined section 82 extends downwardly from the horizontal section 80 and is embedded within the inner lip 50' adjacent to the profiled side 32'. The inner anchoring bar 76 is substantially straight and is embedded within the concrete adjacent to the inner sidewall 48' of the channel 42'. Both the inner and outer anchoring bars 74, 76 extend through the inner lip 50' and project from the bottom surface 30' between the channel 42' and the profiled side 32'.

Prior to construction of the traffic barrier 15, the barrier element 10 is cast with the above-described channel, profiled side and projecting anchoring bars. The casting may be done at a manufacturing plant or on a construction site. After the concrete has set, the precast concrete traffic barrier element 10 is lifted into position from behind the wall face 12 (in a manner similar to the positioning of the panels 20), thereby eliminating the need for scaffolding and forms in front of the wall face 12. Further, the precast concrete traffic barrier eliminates the need for a post and rail type barrier which absorbs rather than redirects the impact from an incident vehicle.

During construction, the precast traffic barrier element 10 is positioned on the wall face 12 of the composite earth structure 14 with the profiled side 32 facing the traffic surface 16. The channel 42 (FIG. 2) of the barrier element 10 is sized to receive the top edge 86 of the wall face 12 for partially supporting the element 10. The center of gravity of the barrier element 10 is in approximate vertical alignment with the channel 42, so that the element 10 does not tilt when positioned on the wall face 12. In this manner, the element 10 is stable and self-supporting on the top edge 86.

Preferably, the wall face 12 is received within the channel 42 such that the top edge 86 contacts the internal face 44 of the channel 42. In this manner, the internal face 44 supports the element 10 on the wall face 12 and gaps between the top edge 86 and the internal face 44 are prevented. If such gaps were allowed to exist, then debris and water could penetrate through the gaps and accumulate behind the wall face 12.

In order to prevent any gaps and to insure that the element 10 is level, concrete fill 87 may be placed on the top edge 86 and allowed to set prior to positioning the element 10. The concrete fill 87 thus presents a level surface which contacts the internal face 44 of the channel 42. In the event that the structure 14 is designed to provide an inclined traffic surface, then the panels 20 may be arranged in a step-like fashion. In such a situation, triangular sections of concrete fill may be placed between exposed corners of the panels 20 in order to provide a smooth, inclined surface upon which the barrier element 10 rests.

With reference to FIG. 1, the element 10, when positioned on the wall face 12, has a length sufficient to cover at least one vertical joint between the interfitted panels 20. With this construction, the barrier element 10 laterally stiffens a top portion of the wall face 12. It is noted that this lateral stiffening of the wall face 12 is accomplished without interfering with differential settlement of the structure 14.

In positioning the barrier element 10 on the wall face 12 (FIG. 2), the inner and outer lips 50, 52 straddle the top edge 86 of the vertical wall 12. In this manner, the outer lip 50 extends or hangs over the top portion of the wall face 12. The overhanging of the outer lip 52 provides the precast concrete traffic barrier 10 with a resistance to overturning, since any impact on the barrier element 10 tending to rotate the element causes the outer lip 52 to cam against the panels 20. Additionally, the outer lip 52 provides the barrier 10 with a drip joint so that rain water or run-off water can drop off the outer lip 52, instead of running down and staining the panels 20 of the wall face 12.

After positioning the barrier element 10 on the wall face 12, the anchoring bars 62, 64 shown in FIG. 2 project toward the traffic surface 16. The anchoring bars 62, 64 are then anchored in a cast in situ counterweight 88 positioned adjacent to the element 10. In this manner, the anchoring bars 62, 64 are embedded within the counterweight 88 which provides the element 10 with additional resistance to an impact from a moving vehicle. The counterweight 88 also laterally stiffens the top portion of the wall face 12. In the embodiment illustrated in FIG. 3, a vertically disposed counterweight may be provided to anchor the anchoring bars 74, 76.

With reference to FIG. 4, at least two barrier elements may be anchored in a single counterweight 88. In anchoring the barrier elements, concrete for the cast in situ counterweight 88 is poured to attach and connect the anchoring bars 62, 64 from preferably four to six traffic barrier elements. As illustrated in the broken away portion of the counterweight 88 of FIG. 4, the anchoring bars 62, 64 are embedded within the counterweight 88. Adjacent counterweights 88 may also be interconnected by reinforcing bars 90. By connecting anchoring bars from a series of barrier elements, the counterweight 88 stiffens the traffic barrier and restrains relative lateral movement between adjacent elements.

After anchoring the barrier elements, a foundation 89 (FIGS. 1 and 2) for the road surface 16 may then be laid and graded over the counterweight 88. The road surface 16 is thus provided with a traffic barrier 15 which rests on the wall face 12 and which is adequately anchored.

The principles, preferred embodiments and modes of operation of the present invention have been described in the foregoing specification. The invention which is intended to be protected herein, however, is not to be construed as limited to the particular embodiments disclosed, since these embodiments are to be regarded as illustrative rather than restrictive. Variations and changes may be made by others without departing from the spirit of the invention. Accordingly, it is expressly intended that all such variations and changes which fall within the spirit and scope of the claims be embraced thereby.

What is claimed is:

1. A traffic barrier for use as a safety device to reist accidental passage of an incident vehicle over a precipitous edge, comprising:

a wall structure defining a top edge, including a wall face fashioned from interfitted facing elements, and having a traffic surface;

a plurality of precast concrete barrier elements in end-to-end relationship along the top edge, each barrier element having a side facing the traffic surface with a cross-sectional profile for redirecting an incident vehicle toward the traffic surface, a bottom surface having a longitudinally extending channel therein, the channel being sized to receive the top edge of the wall structure for partial support of the barrier element, a length sufficient to cover at least one vertical joint between interfitted facing element for lateral stiffening of the wall face, and attachment means toward the traffic surface side of the wall structure for connecting the barrier element with a counterweight; and a cast in situ counterweight on the traffic surface side of the wall structure engaging the attachment means of at least two barrier elements to stiffen the barrier and the wall face while counterbalancing vehicle impact forces.

2. The traffic barrier as recited in claim 1, wherein the barrier element has an outer lip and an inner lip on opposite sides of the channel, the inner lip being adjacent to the traffic surface side, and the outer lip providing a drip joint while resisting overturning of the element due to vehicle impact forces.

3. The traffic barrier as recited in claim 1, wherein the channel has a trapezoidal configuration including an internal face parallel to the bottom surface for supporting the barrier element on the top edge of the wall structure and two sidewalls extending between the internal face and the bottom surface.

4. The traffic barrier as recited in claim 1, wherein the attachment means includes at least one anchoring bar partially embedded within the barrier element and partially projecting outwardly therefrom for anchoring within the counterweight.

5. The traffic barrier as recited in claim 4, wherein the anchoring bar projects through the traffic surface side of the element and is anchored in a substantially horizontally disposed counterweight.

6. The traffic barrier as recited in claim 4, wherein the anchoring bar projects through the bottom surface of the element between the channel and the traffic surface side and is anchored in a substantially vertically disposed counterweight.

7. The traffic barrier as recited in claim 1, wherein the center of gravity of the barrier element is in approximate vertical alignment with the channel for stabilizing the element being supported on the top edge of the wall structure prior to connecting the attachment means to the counterweight.

8. The traffic barrier as recited in claim 1, further comprising means for leveling the top edge of the wall structure in order to provide a level surface for supporting the barrier elements.

9. A traffic barrier element, comprising: a block of precast concrete having a side with a profile for redirecting an incident vehicle away from the side, a bottom surface with a longitudinally extending channel proportioned to receive a wall edge, the channel defined by a depth which exceeds its width, the channel providing an internal face for supporting the barrier element and defining an inner lip and an outer lip on opposite sides of the channel with the inner and outer lips being adapted to straddle the wall edge and being operable to resist overturning of the barrier element due to a camming effect between the outer lip and the wall upon any impact which rotates the block, and anchoring means being partially imbedded within the block and partially projecting from the inner lip, whereby the block can be supported by the channel and can be connected to a counterweight by the anchoring means.

10. A method for constructing a traffic barrier on a top edge of a wall face of a structure having a traffic surface thereon, comprising the steps of:

positioning a precast concrete traffic barrier element on the wall face with the top edge of the wall face being received within a longitudinally extending channel in a bottom surface of the element, the barrier element being supported on the top edge of the wall face with anchoring bars partially embedded within the element projecting outwardly toward the traffic surface; and anchoring the anchoring bars in a cast in situ counterweight positioned adjacent to the traffic surface to stiffen the barrier and the wall face while counterbalancing vehicle impact forces.

11. The method as recited in claim 10, further comprising the step of leveling the top edge of the wall surface prior to positioning the barrier element to provide a level surface for supporting the barrier elements.

12. The method as recited in claim 10, wherein the step of positioning the barrier element on the top edge includes placing the barrier on the top edge such that an outer lip and an inner lip, each depending from the bottom surface of the element on opposite sides of the channel, straddle the top edge of the wall surface so that the outer lip provides a drip joint and a resistance to overturning.

13. The method as recited in claim 10, wherein the step of positioning includes covering at least one vertical joint between interfitted panels of the wall face with the barrier element to laterally stiffen the wall face.

14. The method as recited in claim 10, wherein the step of anchoring the anchoring bars includes anchoring the anchoring bars from a plurality of traffic barriers in a single counterweight to laterally stiffen the elements.

* * * * *